US007287711B2

(12) United States Patent
Crooks

(10) Patent No.: US 7,287,711 B2
(45) Date of Patent: Oct. 30, 2007

(54) ADJUSTABLE ARC ROTOR-TYPE SPRINKLER WITH SELECTABLE UNI-DIRECTIONAL FULL CIRCLE NOZZLE ROTATION

(75) Inventor: John D. Crooks, San Diego, CA (US)

(73) Assignee: Hunter Industries, Inc. a Delaware corporation, San Marcos, CA (US)

( * ) Notice: Subject to any disclaimer, the term of this patent is extended or adjusted under 35 U.S.C. 154(b) by 152 days.

(21) Appl. No.: 11/139,725

(22) Filed: May 27, 2005

(65) Prior Publication Data

US 2006/0273196 A1 Dec. 7, 2006

(51) Int. Cl.
*B05B 3/04* (2006.01)

(52) U.S. Cl. ..... 239/240; 239/201; 239/204; 239/206; 239/242; 239/247; 239/263.3

(58) Field of Classification Search ..... 239/200–207, 239/240, 242, 247, 71, 73, 263.3
See application file for complete search history.

(56) References Cited

U.S. PATENT DOCUMENTS

| | | | | |
|---|---|---|---|---|
| 3,107,056 | A | 10/1963 | Hunter | |
| 4,568,024 | A | 2/1986 | Hunter | 239/242 |
| 4,624,412 | A | 11/1986 | Hunter | 239/232 |
| 4,625,914 | A | 12/1986 | Sexton et al. | 239/206 |
| 4,634,052 | A | 1/1987 | Grizzle et al. | 239/205 |
| 4,718,605 | A | 1/1988 | Hunter | 239/242 |
| 4,784,325 | A | 11/1988 | Walker et al. | 239/204 |
| 4,787,558 | A | 11/1988 | Sexton et al. | 239/205 |
| 4,892,252 | A | 1/1990 | Bruninga | 239/205 |
| 4,901,924 | A | 2/1990 | Kah, Jr. | 239/242 |
| 4,948,052 | A | 8/1990 | Hunter | 239/242 |
| 4,972,993 | A | 11/1990 | Van Leeuwen | 239/206 |
| 5,048,757 | A | 9/1991 | Van Leeuwen | 239/205 |
| 5,383,600 | A | 1/1995 | Verbera et al. | 239/205 |
| 6,042,021 | A | 3/2000 | Clark | 239/205 |
| 6,050,502 | A | 4/2000 | Clark | 239/237 |
| 6,732,950 | B2 * | 5/2004 | Ingham et al. | 239/205 |
| 6,869,026 | B2 * | 3/2005 | McKenzie et al. | 239/237 |
| 6,945,471 | B2 | 9/2005 | McKenzie et al. | 239/237 |
| 7,028,920 | B2 * | 4/2006 | Hekman et al. | 239/240 |
| 2004/0195358 | A1 | 10/2004 | Santiago et al. | 239/200 |

* cited by examiner

*Primary Examiner*—Kevin Shaver
*Assistant Examiner*—Jason Boeckmann
(74) *Attorney, Agent, or Firm*—Michael H. Jester

(57) ABSTRACT

A sprinkler includes a drive mechanism mounted in a riser that rotates a nozzle at the top of the riser. The drive mechanism enables a user to select between oscillation of the nozzle through an adjustable arc and uni-directional full circle rotation of the nozzle.

9 Claims, 4 Drawing Sheets

ADJUSTABLE ARC ROTOR-TYPE SPRINKLER WITH SELECTABLE UNI-DIRECTIONAL FULL CIRCLE NOZZLE ROTATION

BACKGROUND

Irrigation sprinklers for turf and landscaping include spray, impact, and rotor-type sprinklers. The latter are desirable where large areas of uniform coverage are desired. Edwin J. Hunter was the pioneer of gear driven adjustable arc rotor-type sprinklers. Made largely of injection molded plastic parts, a pop-up oscillating rotor-type sprinkler typically includes a riser which telescopes within an outer housing and enclosing a turbine that rotates a nozzle through a gear train and reversing mechanism. The position of one of two arc adjustment tabs or stops can be manually moved, usually with a special tool, to adjust the arc of oscillation. In some cases, an adjustable arc rotor-type sprinkler is equipped with an automatic arc return feature so that the nozzle will resume oscillation between its pre-set arc limits after a vandal has twisted the riser. This prevents watering of sidewalks, patios and other areas besides landscaping, thereby avoiding wasting of water and safety hazards. The nozzle is usually replaceable to achieve the desired trajectory and/or flow rate in gallons per minute. Rotor-type sprinklers used in golf courses often include pneumatically actuated or solenoid-operated valves.

SUMMARY OF THE INVENTION

It would be desirable to have an arc adjustable rotor-type sprinkler that could readily be converted in the field to uni-directional full circle rotation. This would enable maximum coverage during a watering cycle. Such full circle watering could also be advantageous in preventing frost damage and in allowing tangential nozzle thrust to assist or retard the gear drive. Heretofore an adjustable arc rotor-type sprinkler has not been developed that will allow such ready conversion inexpensively, without complexity and with reliability. Avoiding the usage of the reversing mechanism during full circle nozzle rotation would have the added benefit of reducing wear on those parts so they would have a longer life available for subsequent oscillating motion of the nozzle between pre-set arc limits.

In accordance with an embodiment of the invention, a sprinkler includes a drive mechanism mounted in a riser that rotates a nozzle at the top of the riser. The drive mechanism enables a user to select between oscillation of the nozzle through an adjustable arc and uni-directional full circle rotation of the nozzle.

DETAILED DESCRIPTION

In accordance with the invention, a pop-up rotor-type sprinkler 10 incorporates arc adjustment and planetary gear reversal mechanisms of a type well known to those skilled in the art of sprinkler design. See for example, U.S. Pat. Nos. 3,107,056; 4,568,024; 4,624,412; 4,718,605; and 4,948,052 of Edwin J. Hunter, the entire disclosures of which are hereby incorporated by reference. Alternately, the reversal mechanism may comprise one or more ports with a movable member to divert water flow to change the direction of rotation of the nozzle. See U.S. Pat. No. 4,625,914 of Sexton et al. The reversal mechanism may be located in the riser with the drive mechanism, or separate from the drive mechanism in a nozzle head as disclosed in U.S. Pat. No. 6,050,502 of Mike Clark.

Figure 1:
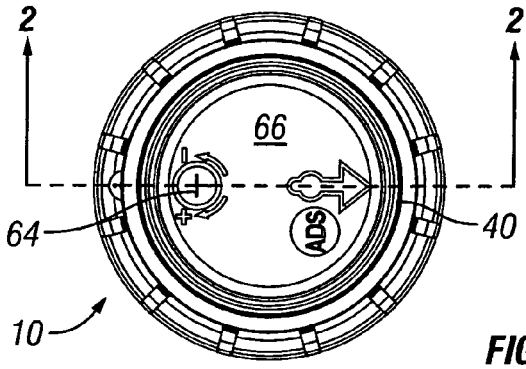
FIG. 1 is a top plan view of a rotor-type sprinkler in accordance with an embodiment of the present invention.
Figure 2:
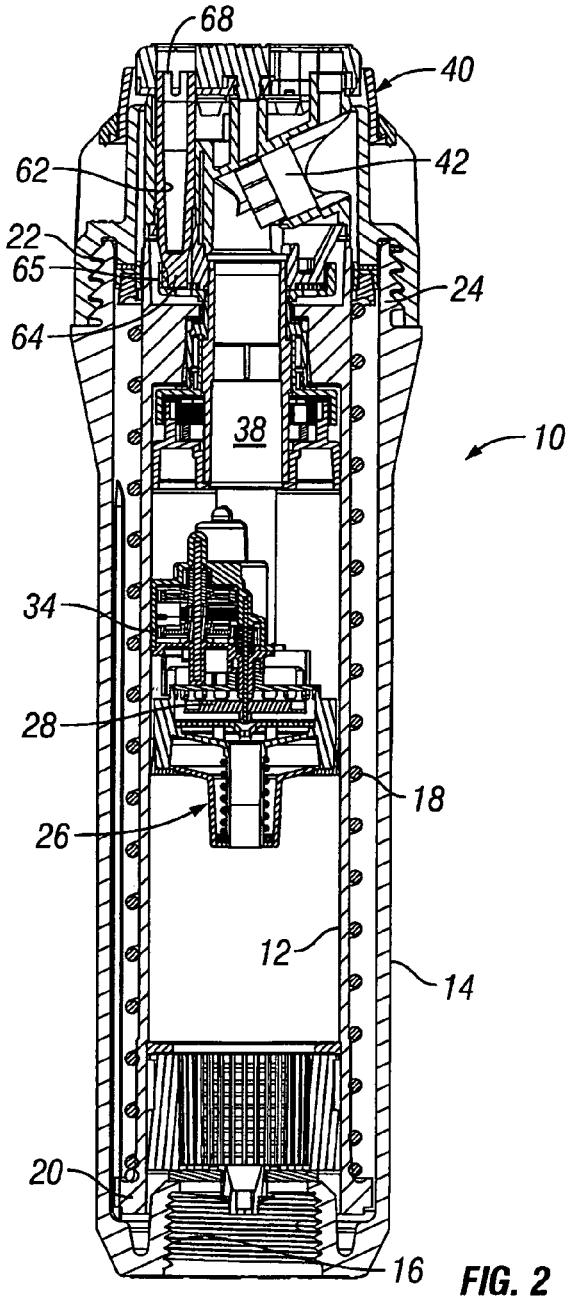
FIG. 2 is a vertical sectional view of the sprinkler of FIG. 1 taken along line 2-2 of FIG. 1.
Figure 5:
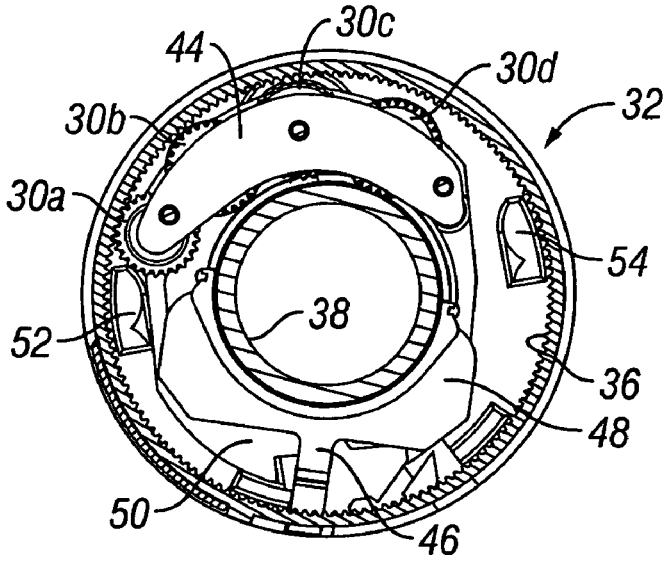
FIGS. 5 and 6 are horizontal sectional views taken along lines 5-5 of FIG. 3 and 6-6 of FIG. 4, respectively, illustrating the position of the reversing mechanism during counter-clockwise and clockwise rotation, respectively, of the nozzle.
Figure 6:
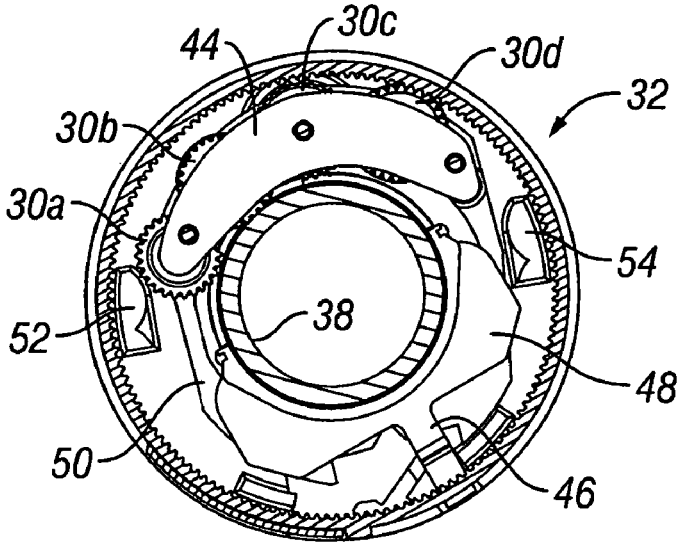

Referring to FIGS. 1 and 2, in accordance with an embodiment of the invention, a pop-up rotor-type sprinkler 10 includes an inner cylindrical riser 12 that extends telescopically within a surrounding cylindrical outer housing 14. The outer housing 14 has a female threaded lower inlet 16 that screws over a male threaded riser (not illustrated) connected to a subterranean PVC water supply line. The riser 12 is normally held in its retracted position by surrounding coil spring 18 compressed between a lower flange 20 of the riser 12 and a female male threaded cylindrical top cap 22 screwed over the male threaded upper end 24 of the outer housing 14. When pressurized water enters the riser 12 through inlet 16 the riser telescopes to its extended position. Water flows into the riser 12 via spring-operated regulator valve 26 which ensures that turbine 28 is driven in a predetermined speed range. The turbine 28 drives a small gear 30*c* (FIG. 5) of a reversing mechanism 32 through a gear train reduction 34 (FIG. 2). The reversing mechanism 32 has a set of planetary gears 30*a*, 30*b*, 30*c* and 30*d* that rock back and forth as illustrated in FIGS. 5 and 6 so that gears 30*a* and 30*d* alternately engage and drive a bull gear assembly 36 in opposite directions. Bull gear assembly 36 turns a hollow drive shaft 38. The hollow drive shaft 38 has external teeth or splines that fit within splines formed on an inner cylindrical extension of the bull gear assembly 36.

Referring still to FIG. 2, a cylindrical head or turret 40 is mounted to the upper end of the hollow drive shaft 38 for rotation at the upper end of the riser 12. The turret 40 encloses a removable nozzle 42 that ejects a stream of water that is conveyed through the hollow drive shaft 38.

Referring to FIG. 5, the reversing mechanism 32 includes upper arm 44 and lower arm (not visible) which carry the axles of the planetary gears 30*a*, 30*b*, 30*c* and 30*d* in such a fashion that they are engaged with each other. The reversing mechanism 32 further includes a resilient shift dog 46 that extends from a shift dog plate 48 that extends around opposite sides of the hollow drive shaft 38. Reversing mechanism 32 further includes a yoke 50 that is moved back and forth by the shift dog 46 to pivot the reversing mechanism 32 about the axle of gear 30*c*. The reversing mechanism 32 is biased over-center by U-shaped springs (not illustrated) made of thin folded sheet steel that are compressed between posts 52 and 54 and shoulders (not illustrated) that project upwardly from the shift dog plate 48. See FIG. 4 of U.S. Pat. No. 6,042,021 of Mike Clark granted Mar. 28, 2000, the entire disclosure of which is hereby incorporated by reference. The folded steel springs ensure that the reversing mechanism 32 will positively shift between the two orientations illustrated in FIGS. 5 and 6 and will not stall in an intermediate orientation.

Figure 3:
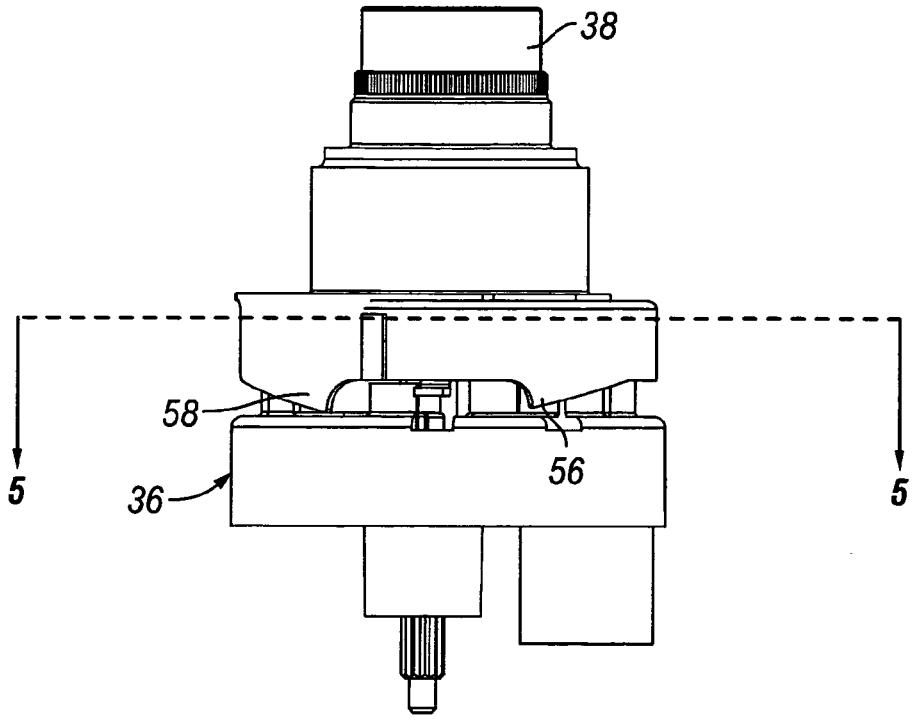
FIGS. 3 and 4 are enlarged side elevation views of the bull gear assembly of the sprinkler of FIG. 1 with its movable arc adjustment tab positioned for oscillating the nozzle between pre-set arc limits.

The bull gear assembly 36 includes a downwardly extending fixed arc adjustment tab 56 (FIG. 3). A downwardly extending movable arc adjustment tab 58 is carried by a bull gear sleeve 60 (FIG. 8) that is rotatable via arc adjustment shaft 62 (FIG. 2). The lower end of the arc adjustment shaft 62 has a small pinion gear 64 that engages a nozzle base gear 65 that drives bull gear sleeve 60. The flanged end of the standard HUNTER® tool (not illustrated) may be inserted through a cross-hair aperture 64 (FIG. 1) in the elastomeric top cover 66 of the turret 40 to engage a slotted upper end 68 (FIG. 2) of the arc adjustment shaft 62. See FIG. 8 of the aforementioned U.S. Pat. No. 6,042,021. This allows the shaft 62 to be rotated to change the position of the movable arc adjustment tab 58 to thereby pre-set the arc of oscillation of the turret 40 and the nozzle 42 carried therein. Thus a position of the movable arc adjustment tab 58 can be adjusted from an upper end of the sprinkler 10. Together, the resilient shift dog 46, arc adjustment tabs 56 and 58, reversing mechanism 32, bull gear assembly 36 and arc adjustment shaft 62 provide a means for enabling a user to select between oscillation of the nozzle 42 through an adjustable arc and uni-directional full circle rotation of the nozzle 42.

Figure 4:
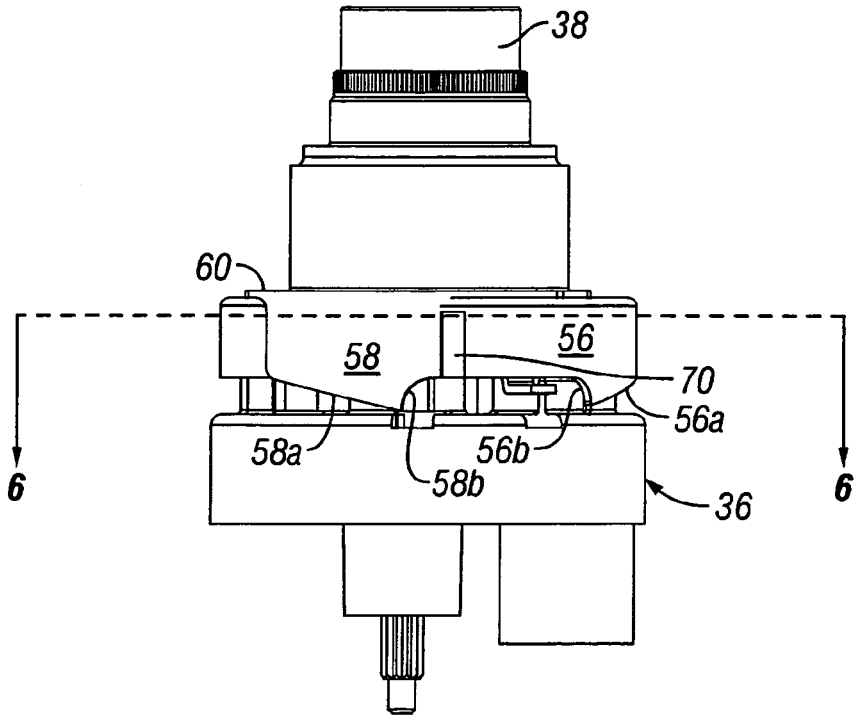

The arc adjustment tabs 56 and 58 (FIG. 3) have a similar saw tooth configuration. The fixed arc adjustment tab 56 is formed with a gradually outwardly inclined edge 56*a* (FIG. 4) and an inwardly curved edge 56*b*. The movable arc adjustment tab 58 is similarly formed with a gradually outwardly inclined edge 58*a* and an inwardly curved edge 58*b*. When the movable arc adjustment tab 58 is spaced apart from the fixed arc adjustment tab 56, as illustrated in FIGS. 3 and 4 the bull gear assembly 36 will rotate clockwise (viewed from above) until curved edge 58*b* of movable arc adjustment tab 58 engages the outer end of shift dog 46, causing it to bend axially downwardly a slight amount until shift dog plate 48 pivots. This causes the bull gear assembly 36 to rotate in the counter-clockwise direction until the curved edge 56*b* of the fixed arc adjustment tab 56 engages the shift dog 46, causing it to bend axially downwardly a slight amount until shift dog plate 48 pivots. This reverses the rotation of the bull gear assembly 36 once again. Should a vandal force the rotation of the turret 40 beyond the pre-set arc limits, the shift dog 46 will engage the curved edge of the arc adjustment tab that it first engages, and bend down axially far enough to clear that arc adjustment tab to thereby prevent damage to any of the mechanisms. The bull gear assembly 36 will then rotate so that the shift dog 46 engages the inclined edge of the other arc adjustment tab and bend downwardly to clear that arc adjustment tab. The turret 40 and the nozzle 42 of the sprinkler 10 will then resume oscillation between the original pre-set arc limits. This automatic arc return feature is advantageous in preventing watering of sidewalks, parking lots, and other non-landscape areas which not only wastes water but can present safety hazards to pedestrians.

Figure 7:
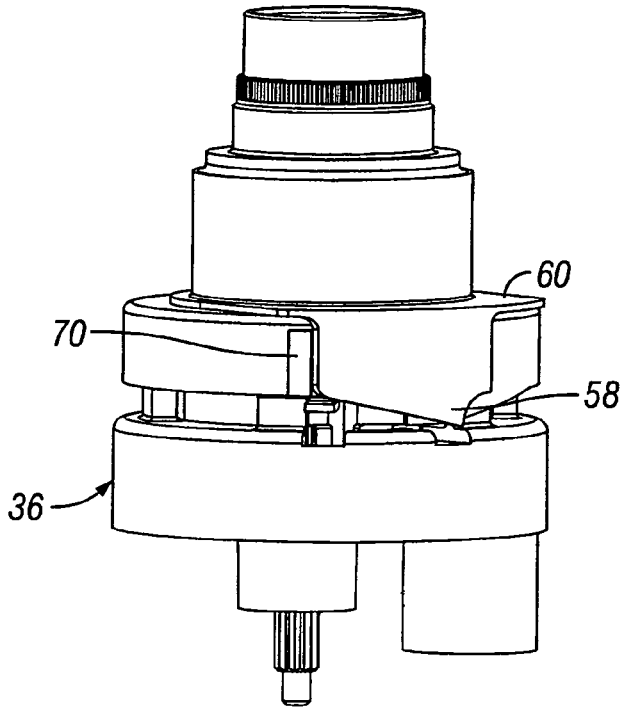
FIGS. 7 and 8 are enlarged perspective views of the bull gear assembly of the sprinkler of FIG. 1 illustrating the manner in which its arc adjustment tabs may be overlapped so that the sprinkler will rotate the nozzle in a uni-directional manner through 360°.
Figure 8:
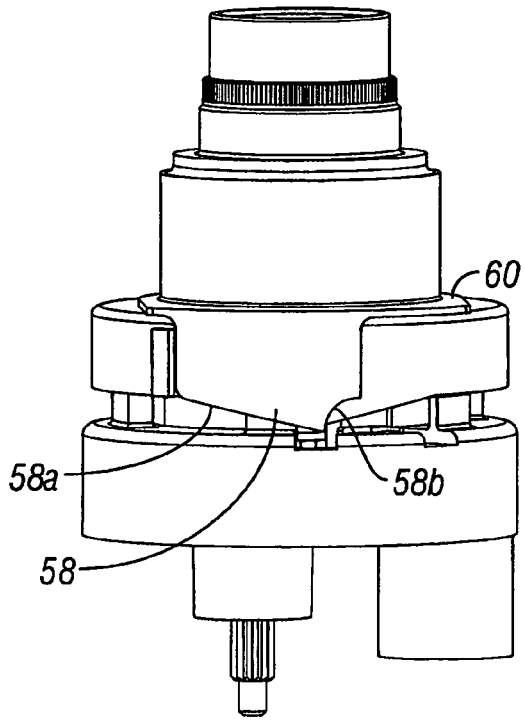

The particular configuration of the arc adjustment tabs 56 and 58 allows the user to pre-select uni-directional rotation of the turret 40 and nozzle 42 through 360° instead of oscillating motion between pre-set arc limits. This is accomplished by moving the movable arc adjustment tab 58 until it circumferentially overlaps with the arc adjustment tab 56 as illustrated in FIGS. 7 and 8. This is done using the HUNTER tool to twist the arc adjustment shaft 62 (FIG. 2) until the movable arc adjustment tab 58 is stopped from further rotation by engaging fixed stop 70 on the outside surface of bull gear assembly 36. The bull gear assembly 36 then rotates in the counter-clockwise direction and the end of the shift dog 46 rides down inclined edge 56*a* of the fixed arc adjustment tab during each revolution. However, because of its gradual taper, insufficient lateral force is exerted on the shift dog plate 48 to shift the reversing mechanism 32. The turret 40 and nozzle 42 thus continue to rotate in a continuous full circle manner in the same direction. Since the reversing mechanism 32 is not shifted during full circle operation unnecessary wear is avoided. Moreover, the angle of the nozzle 42 and/or its ejection orifices can be angled relative to the radius of the sprinkler 10 in order to exert a force that either assists or retards the gear drive.

While an embodiment of the invention has been described in detail, modifications and adaptions thereof will occur to those skilled in the art. For example, both of the arc adjustment tabs could be movable, to avoid the need of twisting the riser 12 within the outer housing 14 or adjusting the angular position of the outer housing 14 to align the arc of coverage with the landscaping to be watered. The full circle rotation could be either clockwise or counter-clockwise. Therefore, the protection afforded the invention should only be limited in accordance with the following claims.

The invention claimed is:

1. A sprinkler, comprising:

a riser;

a nozzle rotatably mounted at a top of the riser for ejecting a stream of water;

a turbine mounted in the riser; and a drive mechanism mounted in the riser and connecting the turbine and the nozzle, the drive mechanism including a gear train reduction connected to a set of gears pivotably engageable with a bull gear assembly to thereby rotate the nozzle in opposite directions, a resilient shift dog connected to pivot the set of gears, the shift dog being movable to pivot the set of gears upon engagement of the shift dog with a fixed arc adjustment tab and a movable arc adjustment tab, both arc adjustment tabs having a saw tooth configuration, the position of the movable arc adjustment tab being adjustable from an upper end of the riser to select oscillating rotation or full circle rotation of the nozzle, and the shift dog being flexed in an axial direction to allow the arc adjustment tabs to be forced past the shift dog.

2. The sprinkler of claim 1 wherein the saw tooth configuration includes a gradually inclined edge.

3. The sprinkler of claim 1 wherein the saw tooth configuration includes a curved edge.

4. The sprinkler of claim 1 wherein full circle rotation is selected by adjusting the movable arc adjustment tab so that it overlaps the fixed arc adjustment tab.

5. The sprinkler of claim 1 wherein the shift dog extends from a shift dog plate.

6. The sprinkler of claim 1 wherein the shift dog moves a yoke that pivots the set of gears.

7. The sprinkler of claim 1 wherein the movable arc adjustment tab is carried by a bull gear sleeve that is rotatable by an arc adjustment shaft.

8. The sprinkler of claim 1 and further comprising a regulator valve mounted at the lower end of the riser.

9. The sprinkler of claim 5 and further comprising at least one spring mounted to bias the set of gears over-center so that the set of gears will not stall in an intermediate position.

* * * * *